US008925167B1

(12) United States Patent
Miller

(10) Patent No.: US 8,925,167 B1
(45) Date of Patent: Jan. 6, 2015

(54) FAUCET HANDLE REMOVAL DEVICE

(71) Applicant: Mannix B. Miller, White Oak, GA (US)

(72) Inventor: Mannix B. Miller, White Oak, GA (US)

( * ) Notice: Subject to any disclaimer, the term of this patent is extended or adjusted under 35 U.S.C. 154(b) by 0 days.

(21) Appl. No.: 13/949,738

(22) Filed: Jul. 24, 2013

(51) Int. Cl.
*B23P 19/04* (2006.01)
*E03C 1/04* (2006.01)

(52) U.S. Cl.
CPC ..... *E03C 1/0412* (2013.01)
USPC ..... 29/256; 254/20; 29/270

(58) Field of Classification Search
USPC ..... 254/18, 20; 29/270, 252, 255, 278, 29/243.5
See application file for complete search history.

(56) References Cited

U.S. PATENT DOCUMENTS

| | | | | | |
|---|---|---|---|---|---|
| 2,916,813 | A | * | 12/1959 | Belanger | 29/256 |
| 3,584,365 | A | * | 6/1971 | Cuen et al. | 29/256 |
| 3,727,491 | A | * | 4/1973 | Buckwalter | 81/53.2 |
| 3,740,814 | A | * | 6/1973 | Marshall | 29/264 |
| 4,079,494 | A | | 3/1978 | Sutton et al. | |
| 4,823,453 | A | | 4/1989 | Bartlett | |
| 5,075,948 | A | * | 12/1991 | Maier | 29/264 |
| 5,119,556 | A | | 6/1992 | Hseu | |
| D340,184 | S | | 10/1993 | Desaulniers | |
| 5,604,967 | A | * | 2/1997 | McMahon | 29/263 |
| 5,915,741 | A | | 6/1999 | Parker | |
| 6,584,662 | B1 | * | 7/2003 | Krick | 29/263 |
| 6,601,277 | B1 | * | 8/2003 | Swanson | 29/256 |
| 6,910,252 | B2 | * | 6/2005 | Draggie et al. | 29/263 |
| 6,929,024 | B1 | | 8/2005 | Rucker | |
| 7,832,071 | B2 | * | 11/2010 | Klann | 29/214 |
| 7,987,571 | B2 | | 8/2011 | English | |
| 8,230,566 | B2 | * | 7/2012 | Oguri | 29/264 |
| 8,256,081 | B2 | * | 9/2012 | Fridman | 29/255 |
| 2009/0236572 | A1 | * | 9/2009 | Laun | 254/18 |

* cited by examiner

*Primary Examiner* — Lee D Wilson
*Assistant Examiner* — Tyrone V Hall, Jr.

(57) ABSTRACT

A faucet handle removal device allows a user to repair a faucet without causing damage to the faucet's handle or stem. The device includes a body having a top wall, a bottom wall, and a perimeter wall extending between the top and bottom walls. The bottom wall and perimeter wall define an interior of the body. An interior edge of the top wall defines an access opening into the interior. A first void extends into the perimeter wall and a second void extends into the bottom wall. The first void is configured to receive the faucet handle and the second void is configured to receive the faucet stem. A screw is insertable into the access opening. The screw has a bottom end configured for positioning within a base of the handle wherein manipulation of the screw drives the screw downwardly into the handle and removes the handle from the stem.

16 Claims, 4 Drawing Sheets

FAUCET HANDLE REMOVAL DEVICE

BACKGROUND OF THE DISCLOSURE

Field of the Disclosure

The disclosure relates to faucet maintenance devices and more particularly pertains to a new faucet maintenance device for allowing a user to repair a faucet without causing damage to the handle or stem of the faucet.

SUMMARY OF THE DISCLOSURE

An embodiment of the disclosure meets the needs presented above by generally comprising a body having a top wall, a bottom wall, and a perimeter wall extending between the top and bottom walls. The bottom wall and perimeter wall define an interior of the body. An interior edge of the top wall defines an access opening into the interior. A first void extends into the perimeter wall and a second void extends into the bottom wall. The first void is configured to receive the faucet handle and the second void is configured to receive the faucet stem. A screw is insertable into the access opening. The screw has a bottom end configured for positioning within a base of the handle wherein manipulation of the screw drives the screw downwardly into the handle and removes the handle from the stem.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
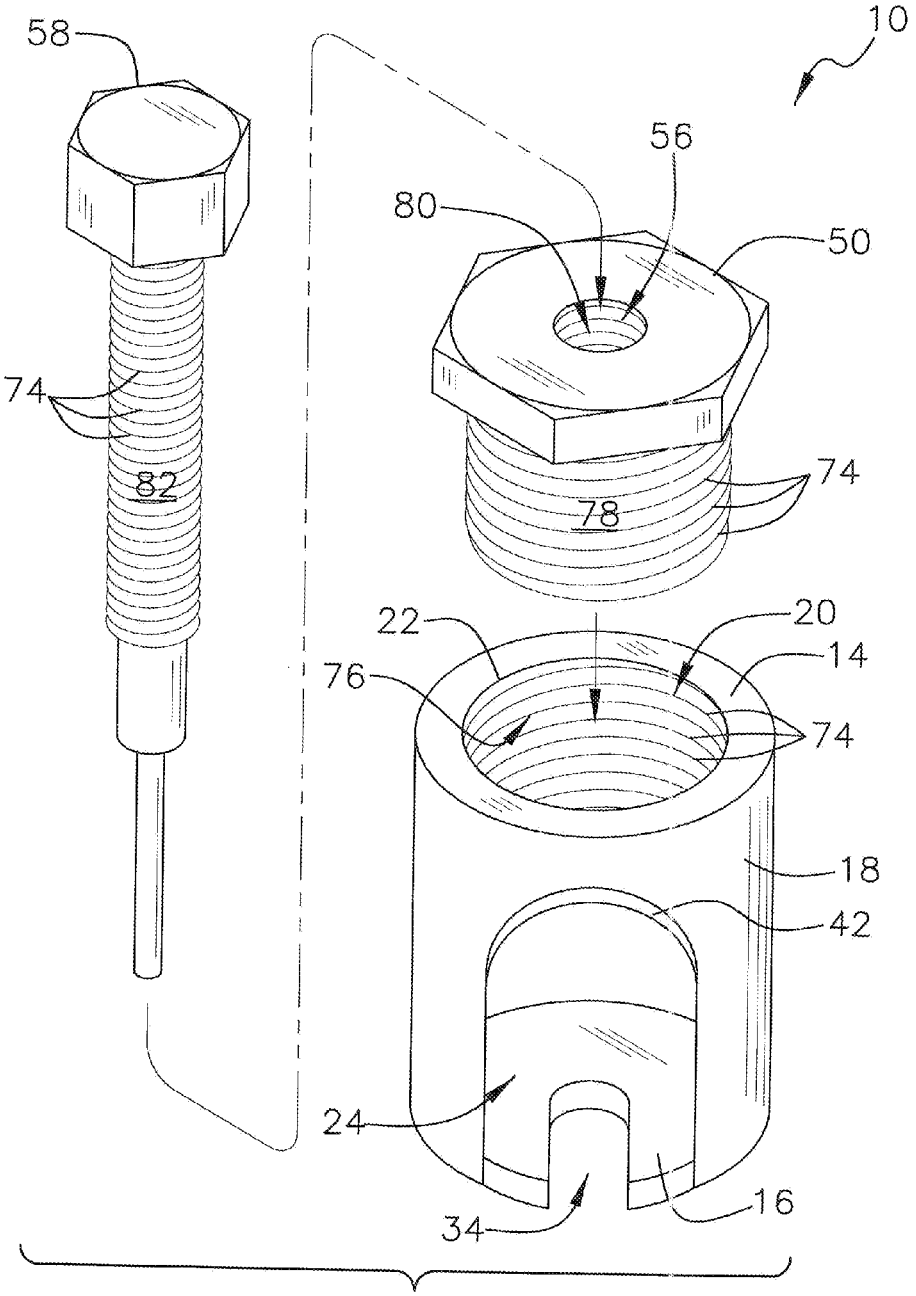
FIG. 1 is an exploded top front side perspective view of a faucet handle removal device according to an embodiment of the disclosure.
Figure 2:
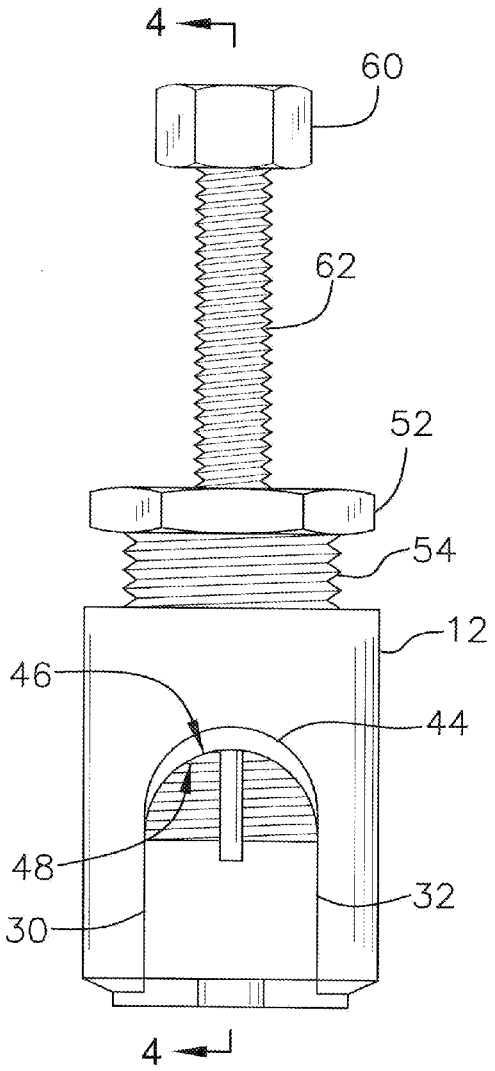
FIG. 2 is a front view of an embodiment of the disclosure.
Figure 3:
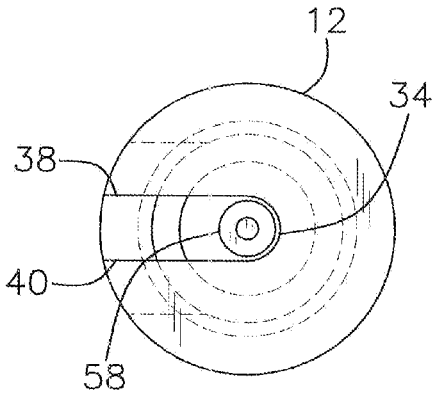
FIG. 3 is a bottom view of an embodiment of the disclosure.
Figure 4:
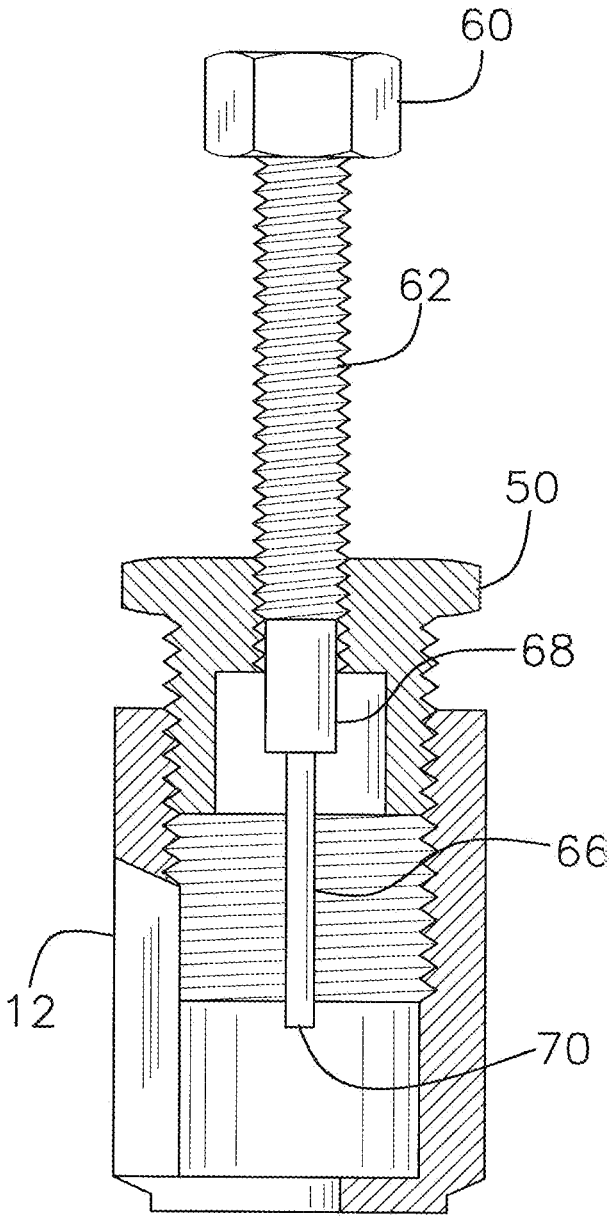
FIG. 4 is a cross-sectional view of an embodiment of the disclosure taken along line 4-4 of FIG. 2.
Figure 5:
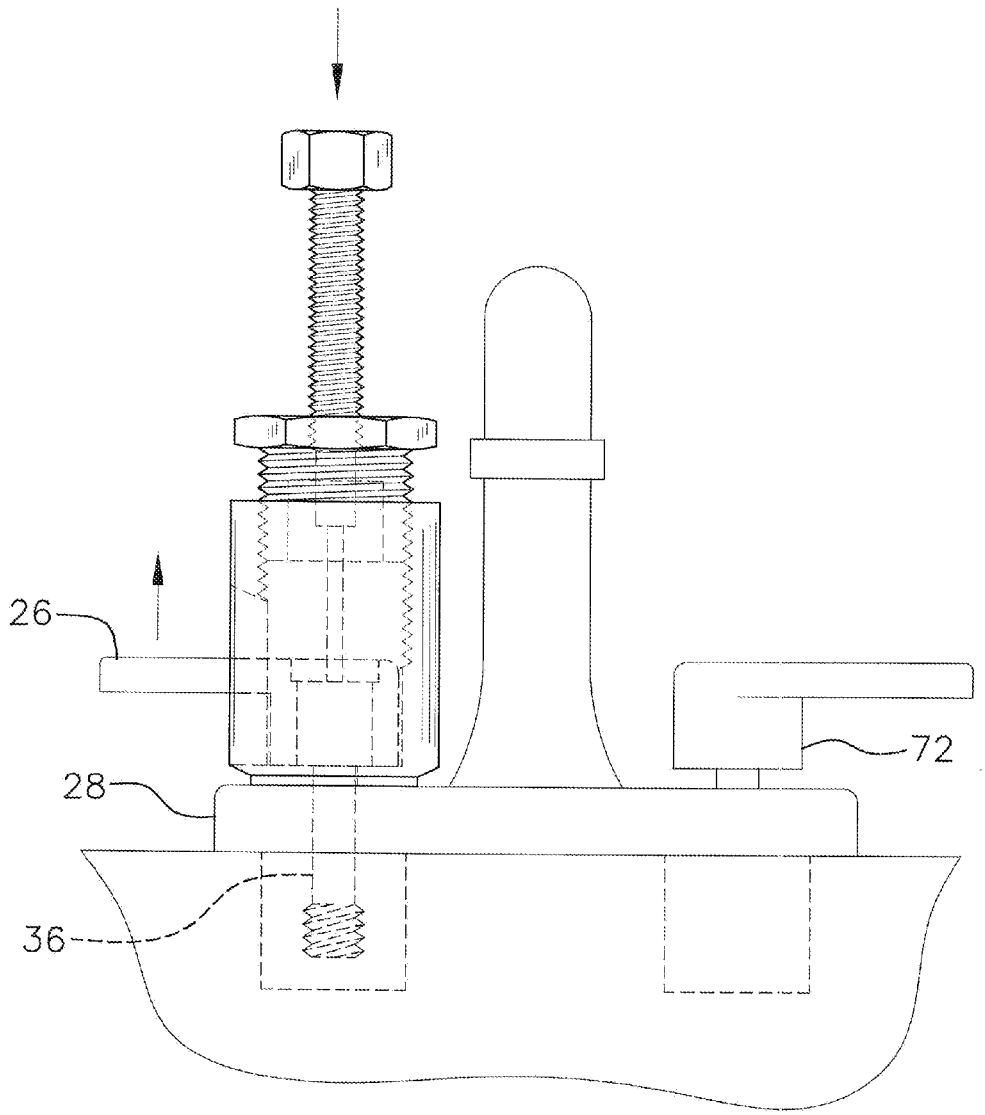
FIG. 5 is an in-use front view of an embodiment of the disclosure.

With reference now to the drawings, and in particular to FIGS. 1 through 5 thereof, a new faucet maintenance device embodying the principles and concepts of an embodiment of the disclosure and generally designated by the reference numeral 10 will be described.

As best illustrated in FIGS. 1 through 5, the faucet handle removal device 10 generally comprises a body 12 having a top wall 14, a bottom wall 16, and a perimeter wall 18 attached to and extending between the top 14 and bottom 16 walls. The bottom wall 16 and the perimeter wall 18 define an interior 20 of the body 12. An interior edge 22 of the top wall 14 defines an access opening into the interior 20. The body 12 may be cylindrical or have any other suitable shape.

A first void 24 extends from the bottom wall 16 upwardly into the perimeter wall 18. The first void 24 is configured to receive a handle 26 of a faucet 28. The first void 24 has a first edge 30 spaced from a second edge 32. A second void 24 extends into the bottom wall 16. The second void 34 is configured to receive a stem 35 of the faucet 28. The second void 34 has a first end 38 spaced from a second end 40. The first 38 and second 40 ends of the second void 34 may be positioned between the first 30 and second 32 edges of the first void 24. Each of the first 24 and second 34 voids may be arcuate. A prominence 42 may extend from the body 12. The prominence 42 has an upper edge 44 and a lower edge 46. The lower edge 46 may be coextensive with a top edge 48 of the first void 24. The prominence 42 may slant upwardly and outwardly from the lower edge 46 toward the upper edge 44. The upper edge 44 may be spaced from the top wall 14.

A fastener 50 may be coupled to the body 12 and comprise a nut portion 52 coupled to a connector portion 54. The fastener 50 has an aperture 56 extending through each of the nut portion 52 and the connector portion 54. The nut portion 52 may have a greater width than the connector portion 54.

An elongated screw 58 is insertable into the access opening 20. The screw 58 has a head 60 and a shaft 62. The shaft 62 may include an upper portion 64, a lower portion 66, and a medial portion 68 attached to and extending between the upper 64 and lower 66 portions. The upper portion 64 may have a greater width than each of the medial 68 and lower 66 portions. The medial portion 68 may have a greater width than the lower portion 66. Each of the upper 64, lower 66 and medial 68 portions is vertically aligned. The lower portion 66 is positionable within the aperture 56 of the fastener 50. The lower portion 66 has a size and shape to extend through the second void 34. A bottom end 70 of the lower portion 66 is configured for positioning within a base 72 of the handle 26 wherein manipulation of the screw 58 drives the screw 58 downwardly into the handle 26 and removes the handle 26 from the stem 36.

A plurality of threads 74 may couple the screw 58 to the fastener 50 and the fastener 50 to the body 12. The threads 74 of the body 12 are positioned on an inner surface 76 of the perimeter wall 18 and may be spaced from the bottom wall 16. The threads 74 of the fastener 50 extend around an exterior surface 78 of the connector portion 54 and an entirety of an interior surface 80 of the fastener 50. The threads 74 of the body 12 releasably engage the threads 74 on the exterior surface 78 of the fastener 50 whereby the fastener 50 is coupled to the body 12. The threads 74 of the screw 58 may be positioned on an outer surface 82 of the upper portion 64. The threads 74 of the screw 58 releasably engage the threads 74 on the interior surface 80 of the fastener 50 whereby the screw 58 is coupled to the fastener 50.

The device 10 may have a height between approximately 12.0 centimeters and 16.0 centimeters and a diameter between approximately 3.5 centimeters and 5.0 centimeters. The lower portion 66 of the screw 58 may be constructed from hardened steel or like material. The remainder of the device 10 may be constructed from carbon steel or other suitable material.

In use, as stated above and shown in the Figures, a cap is removed from the base 72 of the handle 26. The body 12 is positioned over the handle 26 such that the handle 26 extends outwardly of the first void 24 while the stem 36 extends outwardly of the second void 34. The screw 58 is inserted into the aperture 56 and the fastener 50 is attached to the body 12 using threads 74. The screw 58 is tightened thereby causing downward pressure on the handle 26 which removes the handle 26 from the stem 36. In this manner, the device 10 provides increased leverage for removing a handle 26 from a faucet 28 since a bottom of the handle 26 is driven downwardly into the body 12. Such allows a user to provide maintenance to the faucet 28 as required without having to replace the entire faucet 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A faucet handle removal device comprising:

a body having a top wall, a bottom wall, and a perimeter wall attached to and extending between said top and bottom walls, said bottom wall and said perimeter wall defining an interior of said body, an interior edge of said top wall defining an access opening into said interior;

a first void extending from said bottom wall upwardly into said perimeter wall, said first void being configured to receive a handle of a faucet;

a second void extending into said bottom wall, said second void being configured to receive a stem of the faucet;

an elongated screw being insertable into said access opening, said screw having a bottom end configured for positioning within a base of the handle wherein manipulation of said screw drives said screw downwardly into the handle and removes the handle from the stem; and a prominence extending from said body, said prominence having an upper edge and a lower edge, said lower edge being coextensive with a top edge of said first void, said prominence slanting upwardly and outwardly from said lower edge toward said upper edge, said upper edge being spaced from said top wall.

2. The device of claim 1, further comprising said body being cylindrical.

3. The device of claim 1, further comprising:

said first void having a first edge spaced from a second edge;

said second void having a first end spaced from a second end; and wherein said first and second ends of said second void are positioned between said first and second edges of said first void.

4. The device of claim 1, further comprising said first and second voids being arcuate.

5. The device of claim 1, further comprising said screw having a head and a shaft, said shaft including an upper portion, a lower portion, and a medial portion attached to and extending between said upper and lower portions, said upper portion having a greater width than each of said medial and lower portions, said medial portion having a greater width than said lower portion, each of said upper, lower and medial portions being vertically aligned.

6. The device of claim 5, further comprising said lower portion of said screw having a size and shape to extend through said second void.

7. The device of claim 5, further comprising:

a fastener coupled to said body, said fastener comprising a nut portion coupled to a connector portion, said nut portion having a greater width than said connector portion; and an aperture extending through each of said nut portion and said connector portion wherein said lower portion of said screw is positionable within said aperture.

8. The device of claim 7, further comprising a plurality of threads coupling said screw to said fastener and said fastener to said body.

9. A faucet handle removal device comprising:

a body having a top wall, a bottom wall, and a perimeter wall attached to and extending between said top and bottom walls, said bottom wall and said perimeter wall defining an interior of said body, an interior edge of said top wall defining an access opening into said interior, said body being cylindrical;

a first void extending from said bottom wall upwardly into said perimeter wall, said first void being configured to receive a handle of a faucet, said first void having a first edge spaced from a second edge;

a second void extending into said bottom wall, said second void being configured to receive a stem of the faucet, said second void having a first end spaced from a second end, said first and second ends of said second void being positioned between said first and second edges of said first void, each of said first and second voids being arcuate;

a prominence extending from said body, said prominence having an upper edge and a lower edge, said lower edge being coextensive with a top edge of said first void, said prominence slanting upwardly and outwardly from said lower edge toward said upper edge, said upper edge being spaced from said top wall;

a fastener coupled to said body, said fastener comprising a nut portion coupled to a connector portion, said nut portion having a greater width than said connector portion;

an aperture extending through each of said nut portion and said connector portion;

an elongated screw being insertable into said access opening, said screw having a head and a shaft, said shaft including an upper portion, a lower portion, and a medial portion attached to and extending between said upper and lower portions, said upper portion having a greater width than each of said medial and lower portions, said medial portion having a greater width than said lower portion, each of said upper, lower and medial portions being vertically aligned, said lower portion having a size and shape to extend through said second void, said lower portion being positionable within said aperture of said fastener, a bottom end of said lower portion being configured for positioning within a base of the handle wherein manipulation of said screw drives said screw downwardly into the handle and removes the handle from the stem; and a plurality of threads coupling said screw to said fastener and said fastener to said body, said threads of said body being positioned on an inner surface of said perimeter wall, said threads of said body being spaced from said bottom wall, said threads of said fastener extending around an exterior surface of said connector portion and an entirety of an interior surface of said fastener, said threads of said body releasably engaging said threads on said exterior surface of said fastener whereby said fastener is coupled to said body, said threads of said screw being positioned on an outer surface of said upper portion, said threads of said screw releasably engaging said threads on said interior surface of said fastener whereby said screw is coupled to said fastener.

10. A faucet handle removal device comprising:

a body having a top wall, a bottom wall, and a perimeter wall attached to and extending between said top and bottom walls, said bottom wall and said perimeter wall defining an interior of said body, an interior edge of said top wall defining an access opening into said interior;

a first void extending from said bottom wall upwardly into said perimeter wall, said first void being configured to receive a handle of a faucet;

a second void extending into said bottom wall, said second void being configured to receive a stem of the faucet; and an elongated screw being insertable into said access opening, said screw having a bottom end configured for positioning within a base of the handle wherein manipulation of said screw drives said screw downwardly into the handle and removes the handle from the stem, said screw having a head and a shaft, said shaft including an upper portion, a lower portion, and a medial portion attached to and extending between said upper and lower portions, said upper portion having a greater width than each of said medial and lower portions, said medial portion having a greater width than said lower portion, each of said upper, lower and medial portions being vertically aligned.

11. The device of claim 10, further comprising said body being cylindrical.

12. The device of claim 10, further comprising:

said first void having a first edge spaced from a second edge;

said second void having a first end spaced from a second end; and wherein said first and second ends of said second void are positioned between said first and second edges of said first void.

13. The device of claim 10, further comprising said first and second voids being arcuate.

14. The device of claim 10, further comprising said lower portion of said screw having a size and shape to extend through said second void.

15. The device of claim 10, further comprising:

a fastener coupled to said body, said fastener comprising a nut portion coupled to a connector portion, said nut portion having a greater width than said connector portion; and an aperture extending through each of said nut portion and said connector portion wherein said lower portion of said screw is positionable within said aperture.

16. The device of claim 15, further comprising a plurality of threads coupling said screw to said fastener and said fastener to said body.

* * * * *